United States Patent [19]

Snygg et al.

[11] 3,938,918

[45] Feb. 17, 1976

[54] ROTARY VANE DEVICE

[76] Inventors: John Snygg, 433 Prospect St.; Vello H. Ebrok, 410 Prospect St., both of East Orange, N.J. 07017

[22] Filed: Apr. 16, 1974

[21] Appl. No.: 461,413

[52] U.S. Cl. ..... 418/150; 418/241
[51] Int. Cl.[2] ..... FO4C 3/00
[58] Field of Search ..... 418/137, 150, 241

[56] References Cited

UNITED STATES PATENTS

| | | | |
|---|---|---|---|
| 3,748,068 | 7/1973 | Keller | 418/137 |
| 3,797,975 | 3/1974 | Keller | 418/137 |

*Primary Examiner*—C. J. Husar
*Assistant Examiner*—Leonard Smith

[57] ABSTRACT

An eccentric rotary vane device useful either as an engine or a pump. The rotary device has a conventional main chamber, an inlet port and an outlet port communicating with the main chamber, a plurality of angularly related radial vanes, independently pivotable and rotatable about a vane axis within the main chamber. A rotor is eccentrically mounted with respect to the main chamber, and a power delivery shaft is connected with the rotor. Cylindrical vane guides in the form of a single roller or sets of two rollers engage the faces of adjacent vanes on either side so that the vane guides are maintained in substantially uniform engagement with the lateral faces of the vanes as they traverse radially inwardly and outwardly therealong during rotation of the rotor. The vanes have novel configurations on their lateral faces so that substantially a perfect seal is maintained between the vane guides and the lateral faces of the vanes when single rollers are employed as the vane guides and the number of vanes is odd. The invention also includes novel configurations of vane lateral faces for maintaining substantially perfect sealing between the vane guides and the lateral faces of the vanes when the vane guides include a carrier body with two spaced oppositely disposed rollers constituting a vane guide set and the number of vanes is odd or even, and when the vane guides each comprise a pair of mutually contacting rollers.

15 Claims, 8 Drawing Figures

FIG. 7
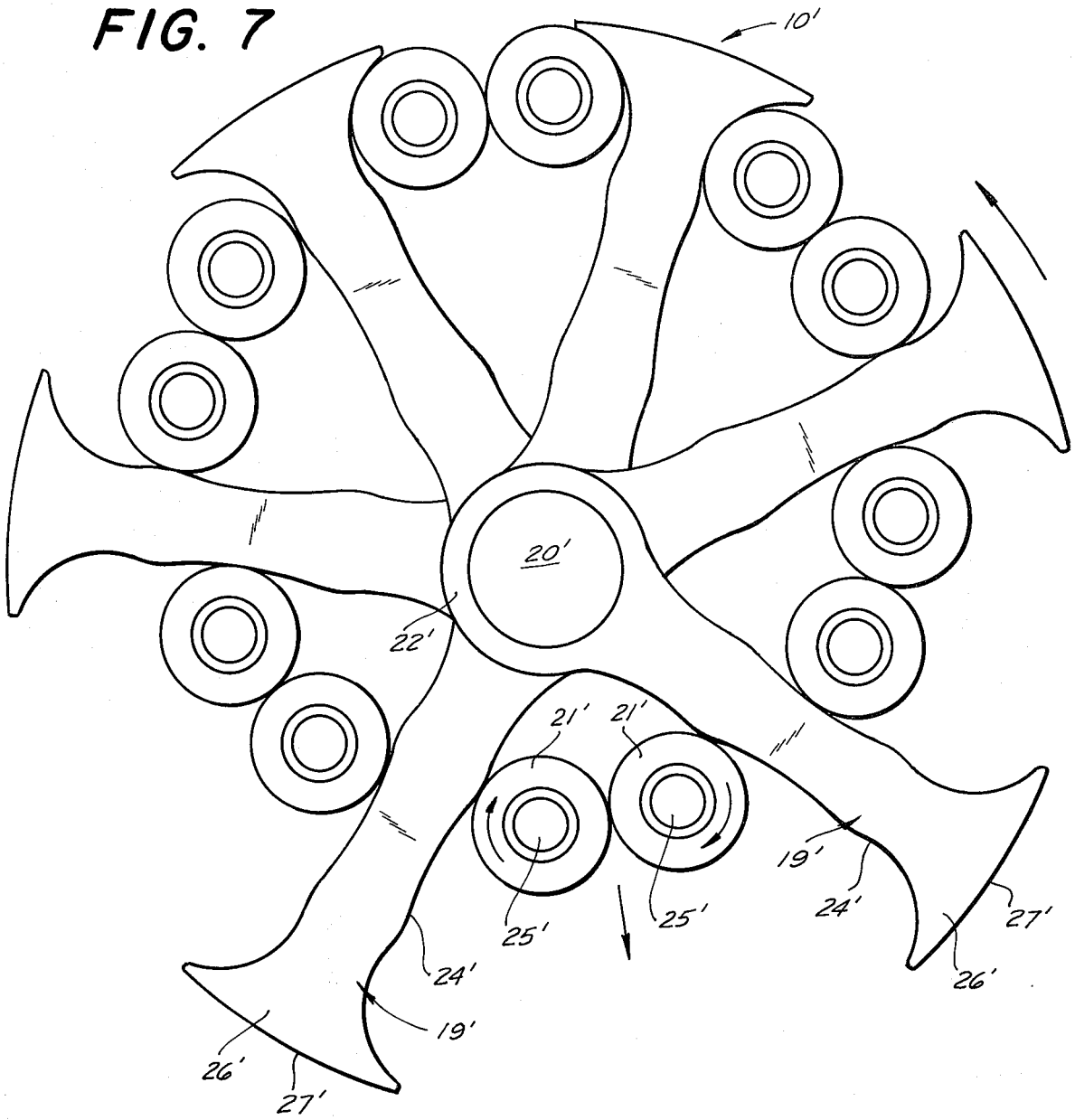
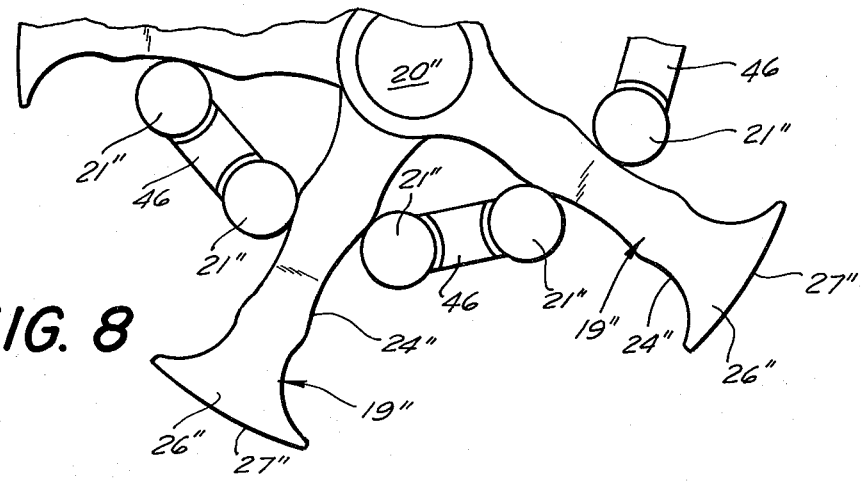
FIG. 8

ROTARY VANE DEVICE

This invention relates to a rotary vane device of the type disclosed in the U.S. Pats. to Keller, No. 3,748,068 dated July 24, 1973 and No. 3,797,975 dated Mar. 19, 1974. Such device is also described in the June, 1973 issue of Popular Science Magazine, volume 202 No. 6, pp. 90–92, where its use as both a steam engine and a pump are described.

Such rotary vane device, however, has a series of problems:

1. The vanes are expensive to build.
2. It is difficult to maintain a good seal between all the chambers of the device; the required pressures for an efficient engine are higher than that required in the internal combustion engine.
3. Up to the time of the present invention, no solution has been available to the problem of designing the vanes so that their lateral surfaces are of such contour that practically complete sealing engagement is maintained between the lateral faces of the vanes and the vane guides throughout the entire paths of travel of such elements during operation of the device.

The present invention has among its objects the provision of a rotary vane device wherein a practically perfect sealing engagement is maintained between the vane guides or followers and the lateral faces of the vanes. This object is attained, in accordance with the present invention, in rotary vane devices having a large degree of variation in the volumes of the sub-chambers between their minimum and maximum volumes, in devices of the type indicated having odd numbers of vanes and single rollers constituting the vane guides, and in devices of this type having an odd or even number of vanes and vane guide sets each composed either of a pair of mutually contacting rollers or of a carrier body with two oppositely disposed rollers contacting respective vanes.

The above and other novel features of the present invention will be apparent from the following detailed description of specific embodiments of the apparatus, when read in conjunction with the accompanying drawings, wherein.

Figure 2:
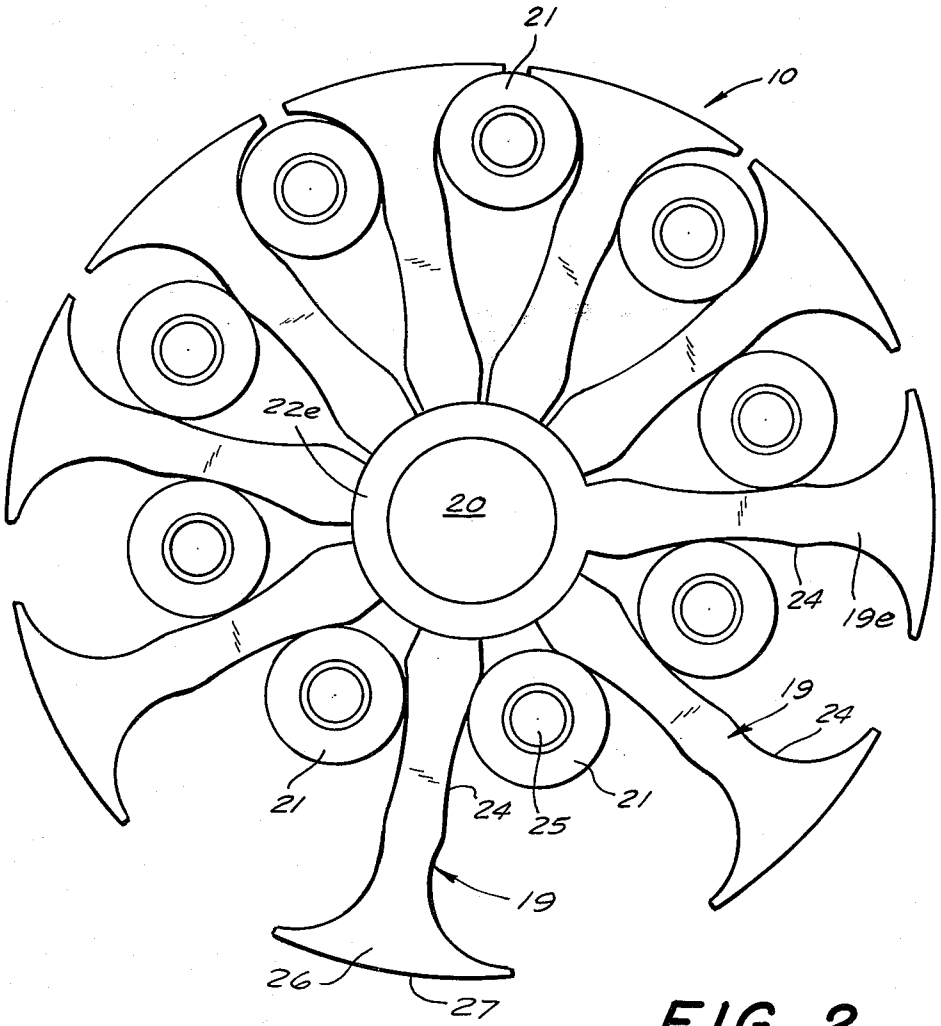
FIG. 2 is a partial side elevational view of the main chamber, vanes and rotor sub-assemblies of a device of the type shown in FIG. 1, the vane chamber being omitted for clarity of illustration.
Figure 5:
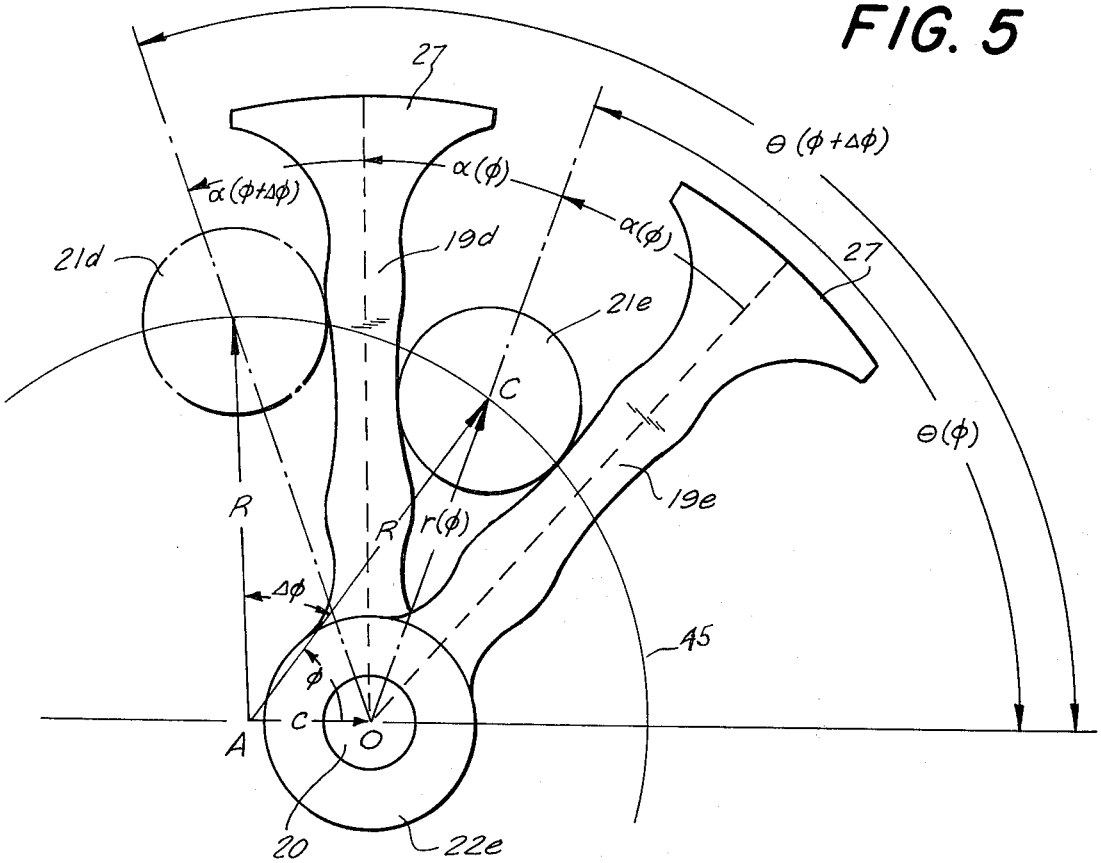
Figure 6:
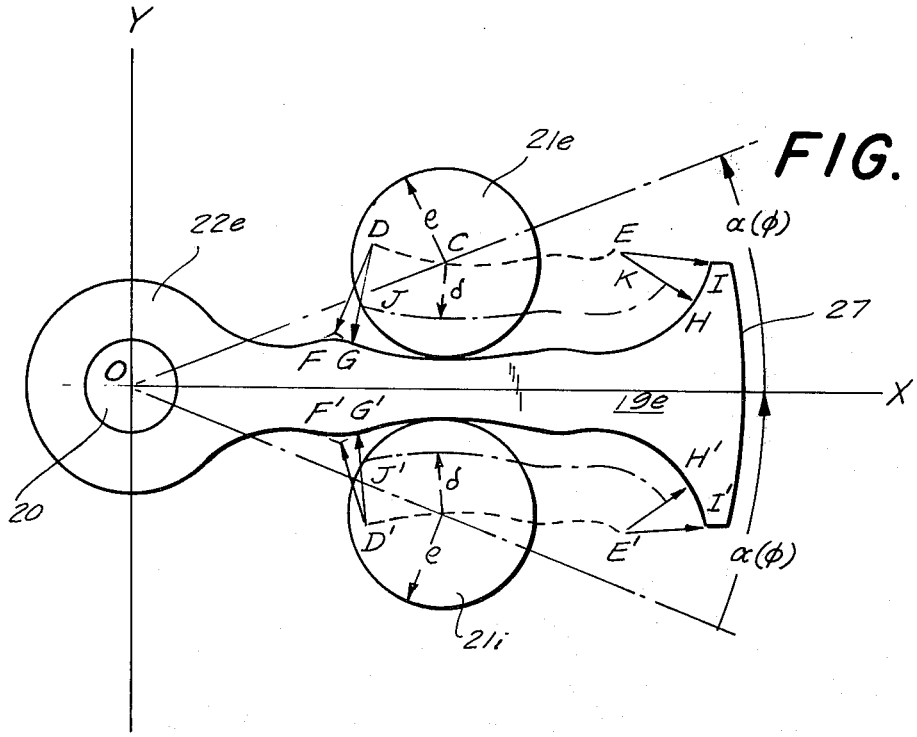

FIG. 5 illustrates the geometry used in the mathematical derivation of the following formulas for (a) the devices in which each vane guide is a single roller, (b) the devices in which each vane guide includes a carrier body with two spaced oppositely disposed rollers constituting a vane guide set, and (c) the devices in which each vane guide comprises a pair of mutually contacting rollers. This figure shows a vane in two successive positions, one shown in full lines and one in phantom lines, which are related to one another as the vane and guide system rotates in a counterclockwise direction;

FIG. 6 is a fragmentary view on a somewhat smaller scale of a single vane of the assembly of FIG. 5, such vane being disposed horizontally with a vane guiding roller disposed on each side thereof, the view showing in dash lines the locus of the center of each of the guide rollers as it travels from its inner terminal to its outer terminal position, the view also showing in phantom lines the loci of the axes of milling cutters which form the two lateral sides of the vane;

FIG. 7 is a view similar to FIG. 2 of a second embodiment having an assembly of six vanes and six sets of vane guides each composed of two mutually engaging vane guide rollers; and FIG. 8 is a view similar to FIG. 2 of a third embodiment having vane guides with a supporting body bearing two oppositely disposed spaced rollers.

Turning now to the drawings, it will be seen that a first embodiment of the rotary vane device in accordance with the invention is illustrated in FIGS. 1–4, inclusive, and that a second embodiment of the rotary vane guide device of the invention is illustrated in FIG. 7, and that a third embodiment of the rotary guide device of the invention is shown in FIG. 8.

The present invention represents an improvement upon those described and claimed in Keller, U.S. Pat. No. 3,748,068 issued July 24, 1973 and Keller U.S. Pat. No. 3,797,975 issued Mar. 19, 1974, which are incorporated herein by reference in their entirety.

Figure 1:
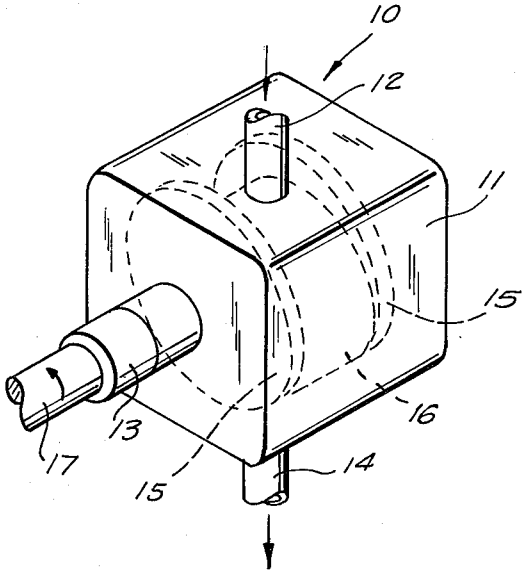
FIG. 1 is a generalized schematic view in perspective of a rotary vane device in accordance with the invention.

In FIG. 1 there is generally shown a vane device, generally designated 10, in accordance with the invention, such device having an outer casing or housing 11, there being a conduit 12 leading to an inlet port. An outlet conduit 14 is connected to an outlet port of the housing 11. When it is desired to run the device, which will be assumed to be a motor, in either direction fluid under pressure such as steam that is introduced into the conduit 12. As is apparent in the two Keller patents referred to above, and as will become apparent from the following description, the device 10 has two parallel shafts, the first of which is a floating pin or stub shaft upon which the vanes are mounted, and the second of which has a cage mounted concentrically thereon. Such cage consists of two face plates 15 which are connected and separated by the stub shafts 25 (FIG. 2) on which vane guide rollers 21 are journalled. The stub shafts 25 are fastened to the face plates 15 by nuts (not shown). Each of such vane guides is disposed between a pair of consecutive vanes. In FIG. 1 the shaft 17, which is journalled in a bearing 13 affixed to the housing 11, bears the cage upon which the vane guides are mounted. In FIG. 1, the space swept by the vanes is schematically designated 16.

Figure 3:
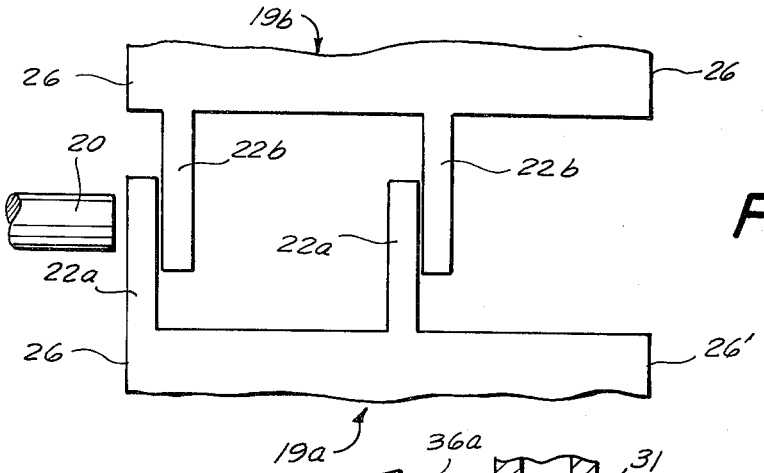
FIG. 3 is a fragmentary view in plan, partly exploded, illustrating two of the vanes and the vane shaft of the embodiment of FIG. 2.
Figure 4:
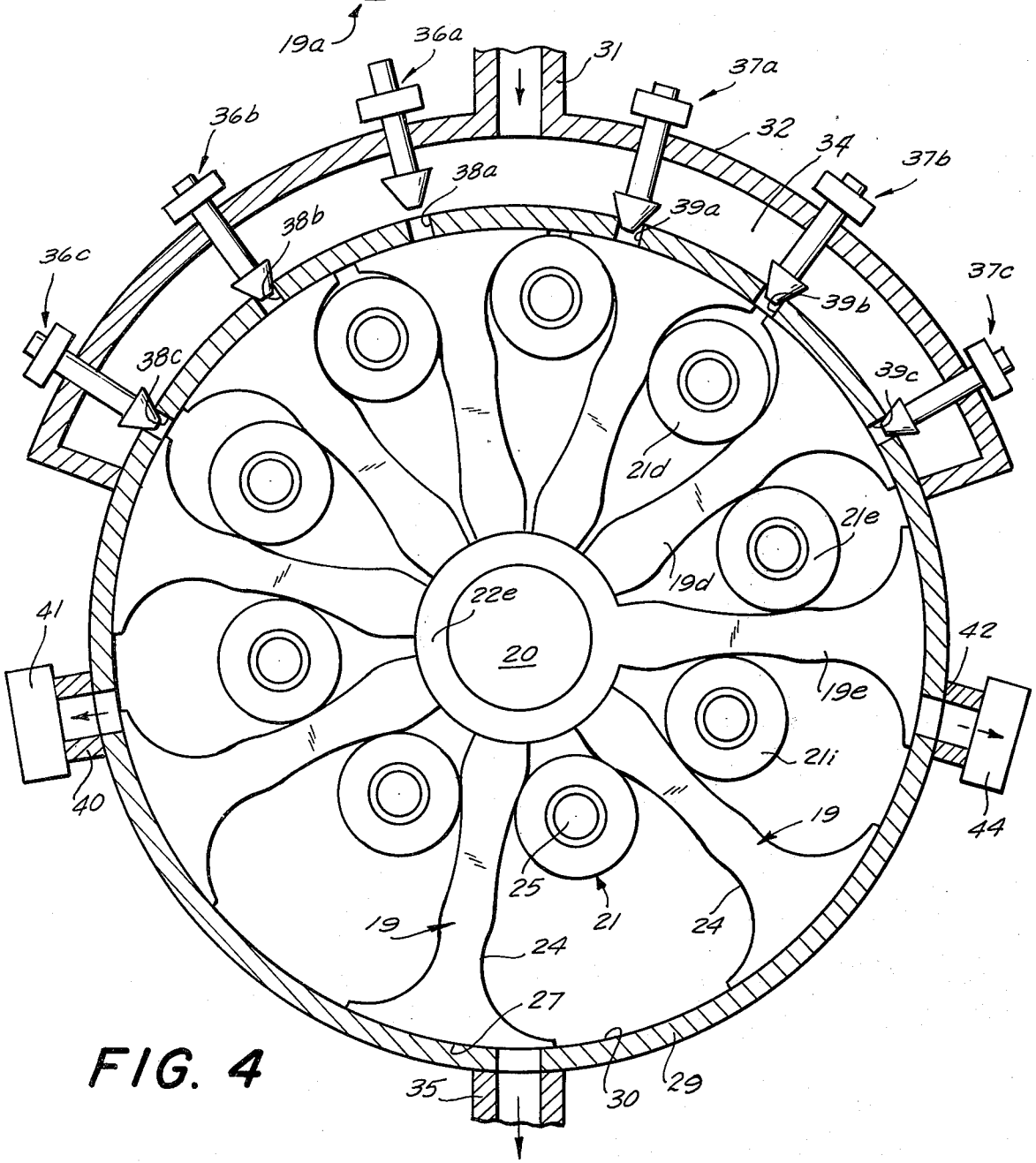
FIG. 4 is a view in elevation of the assembly of vanes and vane guides similar to FIG. 2, such assembly being shown in the main, inner chamber of the device.

Turning now to FIGS. 2–4, inclusive, there is shown somewhat schematically the inner, moving parts of a first embodiment of vane device in accordance with the invention. Such device has an odd number of vanes 19, there being nine such vanes employed in the device shown. The vanes are connected together by having knuckles 22 on their radially inner ends telescoped over a central floating axle pin 20. Taking a give vane 19, such given vane being designated **19*a*, as being the "mid-vane," four of the nine vanes will, like vanes 19*b* (FIG. 3), be disposed with their respective end knuckles axially outwardly of and inwardly of the knuckles of vane 19*a* (considered in the direction from the bottom to the top in FIG. 3), and the other four vanes, of which that vane with its knuckles furthest from those of vane 19*a* is designated 19*i*, will be disposed with their knuckles staggered in the opposite direction with respect to the knuckles of vane 19***a*. The knuckles on the vanes are so disposed that the axial end faces 26 of the vanes are disposed in respective planes so that, when provided with appropriate end seals (not shown), they effect seals with the opposed confronting disc-like end closure members of the housing 11.

In the illustrative embodiment, nine vane guides 21 are employed, one between each successive pair of vanes 19, the vane guides 21 being in the form of rollers journalled upon stub shafts 25 which are affixed to a cage mounted upon and affixed to the shaft 17. It will be seen that as the shaft 17 rotates the rollers 21 travel radially of the axle pin 20 from a radially inner position which is occupied by the two rollers 21 at the bottom of FIG. 2 to a radially outer position which is occupied by the topmost roller 21 in that figure. During such travel the rollers maintain intimate, sealing engagement with the lateral faces 24 of adjacent vanes 19. The vanes 19 have radially outer ends 26 with part-cylindrical outer surfaces 27, surfaces 27 being sealingly engaged with the inner surface 30 of an inner housing member 29 (FIG. 4) at all times. In their travel inwardly from the radially outer position of the roller (at the top in FIG. 2) to their radially inner position (at the bottom in FIG. 2), the space presented between the surfaces 24 of successive vanes 19 radially outwardly of the rollers 21, the surface of the roller 21, and the surface 30 of the inner housing 29 becomes progressively larger, as can be seen at the left in FIG. 2. From the bottom position in FIG. 2 such space becomes progressively smaller until the roller 21 again lies in its radially outermost position.

As shown in FIG. 4, the device has an inner housing 29 in the form of a circular cylindrical sleeve, the inner surface 30 of such sleeve being sealingly engaged by the outer, part-cylindrical surfaces 27 on the radially outer ends of the vanes 19. At the top of the inner casing as it is shown in FIG. 4, there is provided an inlet chamber casing 32 which is fed with fluid such as steam under pressure through a central conduit 31, whereby the chamber 34 thus presented is filled with pressure fluid. The inner casing 29 is provided with an outlet port to which an outlet conduit 35 is connected as shown. The upper wall of the inner housing 29 within the inlet chamber casing 32 is provided with a plurality of ports, there being three ports 38*a*, 38*b* and 38*c* disposed in angularly spaced relationship to the left of the inlet port and conduit 31 and three ports 39*a*, 39*b* and 39*c* to the right of the inlet port 31. Each of said ports is provided with an electromagnetically actuated valve which is schematically shown in FIG. 4, such respective valves being designated 36*a*, 36*b* and 36*c* at the left and 37*a*, 37*b* and 37*c* at the right. If one or more of the valves 36*a*–36*c* is opened, assuming the conduit 31 receives pressure fluid, the vanes 19 rotate counterclockwise about the central floating pin 20. An auxiliary discharge 42, shown at the right, provided with a valve 44, is then employed to discharge a part of the fluid under pressure after it has reached the main discharge port and conduit 35. During such operation the valves 37*a*–37*c*, will of course, remain closed. If, however, the valves 36*a*–36*c* are closed and one or more of valves 37*a*–37*c* are opened, the vanes 19 will rotate in a clockwise direction. In this case the auxiliary discharge valve 44 is closed, whereas a valve 41 associated with a similar, but oppositely disposed auxiliary discharge port and conduit 40, shown at the left in FIG. 4, is opened. Such rotation of the vanes 19 carries the guide rollers 21 with them, and of course, rotates the cage upon which the rollers 21 are journalled and the shaft 17 (FIG. 1) on which the cage is mounted.

Applicant's invention, which comprises vanes of such shape that perfect sealing is attained at all times between the lateral faces 24 of the vanes 19 and the vane guides 21, will be more readily understood upon consideration of FIGS. 5 and 6 of the drawing. FIG. 5 shows a vane in two successive positions which are related to one another as the system rotates in a counterclockwise direction. The relation between the two positions is that the vane guide roller (which may be the entire vane guide or a single member of a pair of rollers in the vane guide) contacting the leading lateral race of the vane in the first position is located in the identical position as the vane guide roller contacting the trailing lateral face of the vane in the second or more counterclockwise position. It is to be understood that the following discussion applies to devices with vane guides having a single roller, to vane guides having a carrier body with two spaced oppositely disposed rollers, and vane guides comprising a pair of mutually contacting rollers. In order to attain such shape, the following conditions must be met:

1. Each vane must maintain contact with the two cylindrical rollers adjacent to it throughout all rotary positions of the vanes and rollers.

2. The centers of the cylindrical vane guide rollers are located on the circumference of a common circle 45, hereafter referred to as the vane guide circle. In FIG. 5 the center of such circle is located at the point A, and the radius of such circle is indicated by R.

3. The angle between the radial lines from the center A in FIG. 5 of the vane guide circle 45 through the centers of two vane guide rollers in contact with a common vane, indicated by $\Delta\phi$ in FIG. 5 remains constant for all rotary positions of the vanes and vane guides.

4. Each vane is allowed to move freely about a point off-center from the vane guide circle 45. In FIG. 5 such point is indicated by O and the distance between this pivot point and the center A of the vane guide circle 45 is indicated by *c*.

5. Measured counterclockwise from the horizontal coordinate in FIG. 5, the radial line extending from the point O through the center of roller 21*e* which is there shown at the right in full lines is displaced through an angle $\theta(\phi)$, and the next radial line passing through the vane guide roller 21*d* shown in phantom lines to the left of the one shown in full lines is displaced counterclockwise from the horizontal coordinate through an angle of $\theta(\phi+\Delta\phi)$.

6. The angle between the central axis of vane 19*e* in the initial right-hand position and the radial line passing through the point O and the center of the full line vane guide roller 21*e* is $\alpha(\phi)$, the angle between the last-named radial line and the longitudinal center line of vane 19*d* in the succeeding left-hand position is also $\alpha(\phi)$, and the angle between such last-named center line and the radial line from the point O passing through the center of the vane guide roller shown at the left in phantom lines is $\alpha(\phi+\Delta\phi)$.

STATEMENT OF EQUATIONS TO BE SOLVED TO SATISFY ABOVE CONDITIONS

From FIG. 5 we see that $$\alpha(\phi) + \alpha(\phi+\Delta\phi) = \theta(\phi+\Delta\phi) - \theta(\phi) \qquad (1)$$

By symmetry it is not difficult to see that $$\alpha(-\phi) = \alpha(\phi) \quad (2a)$$
$$\alpha(\phi+2\pi) = \alpha(\phi) \quad (2b)$$

Also $$\theta(-\phi) = -\theta(\phi) \quad (3a)$$
$$\theta(\phi+2\pi) = \theta(\phi) + 2\pi \quad (3b)$$

Furthermore from the periodic nature of the system it is clear that if m is an integer then $$\alpha(\phi+2\pi m) = \alpha(\phi) \quad (2c)$$
$$\theta(\phi+2\pi m) = \theta(\phi) + 2\pi m \quad (3c)$$

It is important to realize that (1) is valid for all values of $\phi$. In particular we can increase $\phi$ by integral multiples of $\Delta\phi$ and obtain a whole system of equations $$\begin{aligned}
&\alpha(\phi) + \alpha(\phi+\Delta\phi) = \theta(\phi+\Delta\phi) - \theta(\phi)\\
&\alpha(\phi+\Delta\phi) + \alpha(\phi+2\Delta\phi) = \theta(\phi+2\Delta\phi) - \theta(\phi+\Delta\phi)\\
&\alpha(\phi+2\Delta\phi) + \alpha(\phi+3\Delta\phi) = \theta(\phi+3\Delta\phi) - \theta(\phi+2\Delta\phi)\\
&\quad\vdots\\
&\alpha(\phi+(N-2)\Delta\phi)+\alpha(\phi+(N-1)\Delta\phi) = \theta(\phi+(N-1)\Delta\phi)-\theta(\phi+(N-2)\Delta\phi)\\
&\alpha(\phi+(N-1)\Delta\phi)+\alpha(\phi+N\Delta\phi) = \theta(\phi+N\Delta\phi)-\theta(\phi+(N-1)\Delta\phi)
\end{aligned} \quad (4)$$

NO SOLUTION EXISTS FOR CERTAIN VALUES OF $\Delta\phi$

For certain values of $\Delta\phi$, the system (4) is inconsistent and has no solution. For example, there is no solution for the problem of obtaining the exact mathematically correct contour of the lateral faces 24 of the vanes 19 when the engine contains an even number of vanes and has single roller vane guides.

In this circumstance $$\Delta\phi = 2\pi/(2n) \quad (5)$$

where 2n is an even integer designating the number of vanes.

To see that the system of equations (4) is inconsistent in this case, we set N = 2n, multiply alternating equations in system (4) by −1 and sum up both sides.

$$\begin{aligned}
&\alpha(\phi) + \alpha(\phi+\Delta\phi) = \theta(\phi+\Delta\phi) - \theta(\phi)\\
&-\alpha(\phi+\Delta\phi) - \alpha(\phi+2\Delta\phi) = \theta(\phi+\Delta\phi) - \theta(\phi+2\Delta\phi)\\
&\alpha(\phi+2\Delta\phi) + \alpha(\phi+3\Delta\phi) = \theta(\phi+3\Delta\phi) - \theta(\phi+2\Delta\phi)\\
&-\alpha(\phi+3\Delta\phi) - \alpha(\phi+4\Delta\phi) = \theta(\phi+3\Delta\phi) - \theta(\phi+4\Delta\phi)\\
&\quad\vdots\\
&\alpha(\phi+(2n-2)\Delta\phi) =)+\alpha(\phi(2n-1)\Delta = \theta(\phi+(2n-1)\Delta\phi) - \theta(\phi+(2n-2)\Delta\phi)\\
&-\alpha(\phi+(2n-1)\Delta\phi)-\alpha(\phi+2n\Delta\phi) = \theta(\phi+(2n-1)\Delta\phi) - \theta(\phi+2n\Delta\phi)
\end{aligned}$$

$$\alpha(\phi) - \alpha(\phi+2n\Delta\phi) = 2\sum_{k=1}^{n} \theta(\phi+(2k-1)\Delta\phi) - 2\sum_{k=1}^{n} \theta(\phi+2k\Delta\phi) + \theta(\phi+2n\Delta\phi) - \theta(\phi) \quad (6)$$

From (2), (3), and (5) we see that $$\alpha(\phi) - \alpha(\phi+2n\Delta\phi) = \alpha(\phi) - \alpha(\phi+2\pi) = 0$$
$$\theta(\phi+2n\Delta\phi) - \theta(\phi) = \theta(\phi+2\pi) - \theta(\phi) = 2\pi \quad (7)$$

Thus (6) implies $$0 = \sum_{k=1}^{n} \theta(\phi+(2k-1)\Delta\phi) - \sum_{k=1}^{n} \theta(\phi+2k\Delta\phi) + \pi \quad (8)$$

It can be shown that the right-hand side of (8) is $-\arctan(2\,[c/R]^n \sin n\phi / [1-(c/R)^{2n}])$ which is clearly not zero.

This is an important point since the single roller models so far built have eight vanes for which $\Delta\phi = 2\pi/8$. The first models leaked substantial amounts of steam when tested.

EXACT SOLUTIONS

It is to be understood that the following discussion applies to devices (a) in which each vane guide is a single roller, (b) in which each vane guide includes a carrier body with two spaced oppositely disposed rollers constituting a vane guide set, and (c) in which each vane guide comprises a pair of mutually contacting rollers.

If $$\Delta\phi = 2\pi m/(2n+1) \quad (9)$$

where $m$ and $n$ are positve integers such that $m$ and $2n+1$ have no common divisors, then (4) has an exact solution. A useful example would be $m = 1$ and $n = 4$. This $\Delta\phi$ would be used in a nine vane single roller type engine.

Returning to system (4) for $\Delta\phi = 2\pi m/(2n+1)$, we set N = 2n+1 and again multiply alternating equations by −1. But now we have an odd number of equations. Thus $$\begin{aligned}
&\alpha(\phi) + \alpha(\phi+\Delta\phi) = \theta(\phi+\Delta\phi) - \theta(\phi)\\
&-\alpha(\phi+\Delta\phi) - \alpha(\phi+2\Delta\phi) = \theta(\phi+\Delta\phi) - \theta(\phi+2\Delta\phi)\\
&\alpha(\phi+2\Delta\phi) + \alpha(\phi+3\Delta\phi) = \theta(\phi+3\Delta\phi) - \theta(\phi+2\Delta\phi)\\
&-\alpha(\phi+3\Delta\phi) - \alpha(\phi+4\Delta\phi) = \theta(\phi+3\Delta\phi) - \theta(\phi+4\Delta\phi)\\
&\quad\vdots\\
&-\alpha(\phi+(2n-1)\Delta\phi)-\alpha(\phi+2n\Delta\phi) = \theta(\phi+(2n-1) - \theta(\phi+2n\Delta\phi)\\
&\alpha(\phi+2n\Delta\phi)+\alpha(\phi+(2n-1)\Delta\phi) = \theta(\phi+(2n+1)\Delta\phi) - \theta(\phi+2n\Delta\phi)
\end{aligned}$$

$$\alpha(\phi) + \alpha(\phi+(2n+1)\Delta\phi) = 2\left[\sum_{k=1}^{n} \theta(\phi+(2k-1)\Delta\phi) - \sum_{k=1}^{n} \theta(\phi+2k\Delta\phi)\right] + \theta(\phi+(2n+1)\Delta\phi)-\theta(\phi) \quad (10)$$

Taking advantage of (2c), (3c) and (9) we obtain $\alpha(\phi) + \alpha(\phi+(2n+1)\Delta\phi) = \alpha(\phi) + \alpha(\phi+2\pi m) = 2\alpha(\phi)$ $\theta(\phi+(2n+1)\Delta\phi) - \theta(\phi) = \theta(\phi+2\pi m) - \theta(\phi) = 2\pi m$.

Therefore (10) becomes $$\alpha(\phi) = \sum_{k=1}^{n} \theta(\phi+(2k-1)\Delta\phi) - \sum_{k=1}^{n} \theta(\phi+2k\Delta\phi) + \pi m. \quad (11)$$

If we reverse the order of summation in the first term on the right-hand side of (11), we have $$\sum_{k=1}^{n} \theta(\phi+(2k-1)\Delta\phi) = \sum_{k=1}^{n} \theta(\phi-2k\Delta\phi+(2n+1)\Delta\phi) = \sum_{k=1}^{n} \theta(\phi-2k\Delta\phi) + 2\pi mn.$$

Therefore equation (11) becomes $$\alpha(\phi) = 2\pi\, mn + \pi m + \sum_{k=1}^{n} \theta(\phi-2k\Delta\phi) - \sum_{k=1}^{n} \theta(\phi+2k\Delta\phi) \tag{12}$$

Thus $$\exp i\,\alpha(\phi) = (-1)^m \exp i \left[ \sum_{k=1}^{n} [\theta(\phi - 2k\Delta\phi) - \theta(\phi + 2k\Delta\phi)] \right]$$

$$= (-1)^m \exp \prod_{k=1}^{n} \exp i[\theta(\phi-2k\Delta\phi) - \theta(\phi+2k\Delta\phi)] \tag{13}$$

From FIG. 5, it is possible to show that $\tan\theta(\phi) = R \sin\phi / (R\cos\phi - c)$ $\sin\theta(\phi) = R\sin\phi / r(\phi)$ $\cos\theta(\phi) = (R\cos\phi - c)/r(\phi)$ $\exp i\theta(\phi) = R[\exp(i\phi) - c/R]/r(\phi)$ (14)

where $r(\phi) = R\sqrt{1 - 2(c/R)\cos\phi + (c/R)^2}$ (15)

$\exp i[\theta(\phi-2k\Delta\phi) - \theta(\phi+2k\Delta\phi)] = \exp[i\,\theta(\phi-2k\Delta\phi)]\cdot\exp[-i\,\theta(\phi+2k\Delta\phi)]$ (16)

Since (3*a*) is valid for arbitrary values of the dependent variable $\phi$, it is also valid for the argument $\phi + 2k\Delta\phi$. Thus $\exp[-i\,\theta(\phi+2k\phi)] = \exp i\,\theta(-\phi-2k\Delta\phi)$ (17)

In addition (14) is also valid for arbitrary values of the dependent variable $\phi$. Thus we can replace $\phi$ in (14) by $\phi - 2k\Delta\phi$ or $-\phi-2k\Delta\phi$. Therefore $\exp i\theta(\phi-2k\Delta\phi) = R[\exp(i\phi-2k\Delta\phi) - c/R]/r(\phi-2k\Delta\phi)$ $\exp i\theta(-\phi-2k\Delta\phi) = R[\exp(-i\phi-i2k\Delta\phi) - c/R]/r(-\phi-2k\Delta\phi)$ (18)

Since $\cos\phi$ is an even function, it is clear from (15) that $$r(-\phi-2k\Delta\phi) = r(\phi+2k\Delta\phi)$$

From (16), (17) and (18) we have $\exp i[\theta(\phi-2k\Delta\phi) - \theta(\phi+2k\Delta\phi)] = (R^2/[r(\phi-2k\Delta\phi)\cdot r(\phi+2k\Delta\phi)])\cdot\exp(-i4k\Delta\phi) - (c/R)(\exp(-i2k\Delta\phi)\cdot[\exp(i\phi)+\exp(-i\phi)]+(c/R)^2)$ (19)

But $\exp(i\phi) + \exp(-i\phi) = 2\cos\phi\,\exp(-i4k\Delta\phi) = \exp(-i2k\Delta\phi)\cdot(\exp(-i2k\Delta\phi) + \exp(i2k\Delta\phi)) - 1 = 2\cos(2k\Delta\phi)\exp(-i\,2k\Delta\phi) - 1.$ Thus (19) becomes $\exp i[\theta(\phi-2k\Delta\phi) - \theta(\phi+2k\Delta\phi)] = (R^2/[r(\phi-2k\Delta\phi)\cdot r(\phi+2k\Delta\phi)])\cdot[\exp(-i2k\Delta\phi)\cdot(2\cos(2k\Delta\phi) - 2(c/R)\cos\phi) - 1 + (c/R)^2]$ (20)

For the sake of brevity we now suppress the quantity $\Delta\phi$ which is a constant for any given machine and introduce the quantities $c(k) = \cos(2k\Delta\phi)$ $s(k) = \sin(2k\Delta\phi)$ $f(k,\phi) = \cos(2k\Delta\phi) - (c/R)\cos\phi$ $a = (\tfrac{1}{2})(1 - (c/R)^2)$ (21)

Using the new quantities and dividing (20) into its real and imaginary parts we get $\exp i[\theta(\phi-2k\Delta\phi) - \theta(\phi+2k\Delta\phi)] = (2R^2/[r(\phi-2k\Delta\phi)\cdot r(\phi+2k\Delta\phi)])\cdot[(c(k)\cdot f(k,\phi)-a) - i\,s(k)\cdot f(k,\phi)]$ (21a)

Now $|\exp i[\theta(\phi-2k\Delta\phi) - \theta(\phi+2k\Delta\phi)]| = 1$

Thus $$\frac{2R^2[(c(k)\cdot f(k,\phi)-a)^2 + (s(k)\cdot f(k,\phi))^2]^{1/2}}{[r(\phi-2k\Delta\phi)\cdot r(\phi+2k\Delta\phi)]} = 1$$

Since from (21) $[c(k)]^2 + [s(k)]^2 = 1$ it is possible to show $$2R^2/[r(\phi-2k\Delta\phi)\cdot r(\phi+2k\Delta\phi)] = 1/[f^2(k,\phi) - 2a\cdot c(k)\cdot f(k,\phi) + a^2]^{1/2} \tag{22}$$

Now from (13), (21a), and (22) we obtain $$\exp(i\alpha(\phi)) = (-1)^m \prod_{k=1}^{n} \frac{[(c(k)\cdot f(k,\phi)-a) - is(k)\cdot f(k,\phi)]}{[f^2(k,\phi)-2a\cdot c(k)\cdot f(k,\phi)+a^2]^{1/2}} \tag{23}$$

We note that in FIGS. 5 and 6 the center of the vane guide roller is denoted by C. By examining FIGS. 5 and 6, we see as $\phi$ increases from O to $\pi$ in FIG. 5, point C moves along path DE in FIG. 6 from point D to E.

Thus if we write the coordinates of point C as a function of $\phi$, we have a parametric equation for path DE. From FIGS. 5 and 6

$X_{DE}(\phi) = r(\phi)\cdot\cos(\alpha(\phi))$ $Y_{DE}(\phi) = r(\phi)\cdot\sin(\alpha(\phi))$ That is $X_{DE}(\phi) = r(\phi)\,\mathrm{Re}\exp(i\,\alpha(\phi))$ $Y_{DE}(\phi) = r(\phi)\,\mathrm{Im}\exp(i\,\alpha(\phi))$ $O \leq \phi \leq \pi$ (24)

In FIG. 6 there are shown a single vane and the two vane guide rollers on opposite sides thereof making sealing contact with the opposite lateral faces 24 of the vane. In such figure O represents the center of the stub shaft 20. DE = path of vane guide center relative to vane. The path DE in FIG. 6 is generated as $\phi$ goes from O to $\pi$. GH = envelope generated by circle of radius $\rho$ moving along the path DE. This is also generated by taking points at distance $\rho$ along normals to path DE. FG = circular arc of radius $\rho$ and center at D. HI = circular arc with radius $\rho$ and center at E.

CALCULATION OF THE PATH JK (FIG. 6)

Path JK in FIG. 6 is the necessary path for the center of a milling cutter if the vane is to be cut on a milling machine. If the vane is to be cut on a jig grinder, the stations of the centers of the successive cuts must be chosen sufficiently close together from path JK.

To obtain JK let $\rho$ = radius of vane guide roller $b$ = radius of milling cutter or grinding wheel $\delta = \rho - b.$ (25)

For path JK $x(\phi) = x_{DE}(\phi) + \delta\cdot y_{DE}'(\phi) / \sqrt{(x_{DE}'(\phi))^2 + (y_{DE}'(\phi))^2}$ $y(\phi) = y_{DE}(\phi) - \delta\cdot x_{DE}'(\phi) / \sqrt{(x_{DE}'(\phi))^2 + (y_{DE}'(\phi))^2}$ where $X_{DE}'$ and $Y_{DE}'(\phi)$ are respectively the first derivatives of $X_{DE}(\phi)$ and $Y_{DE}(\phi)$ with respect to $\phi$.

After some computation we obtain for the path of the milling cutter (JK of FIG. 6)

$x(\phi) = x_{DE}(\phi) + \delta\,[y_{DE}(\phi) + x_{DE}(\phi)\cdot s_O(\phi)]/(r(\phi)\cdot\sqrt{1+(s_O(\phi))^2})$ $y(\phi) = y_{DE}(\phi) - \delta\,[x_{DE}(\phi) - y_{DE}(\phi)\cdot s_O(\phi)]/(r(\phi)\cdot\sqrt{1+(s_O(\phi))^2})$ $$O \leq \phi \leq \pi \tag{26}$$

In formula (26)

$x_{DE}(\phi) = r(\phi)\,\mathrm{Re}\exp(i\,\alpha(\phi))$ $y_{DE}(\phi) = r(\phi)\mathrm{Im}\exp(i\alpha(\phi))$ $r(\phi) = \sqrt{R^2 + c^2 - cR\cos\phi}$ $$\exp(i\alpha(\phi)) = (-1)^m \prod_{k=1}^{n} \frac{[(c(k)\cdot f(k,\phi)-a) - is(k)\cdot f(k,\phi)]}{[f^2(k,\phi)-2a\cdot c(k)\cdot f(k,\phi)+a^2]^{1/2}}$$

$c(k) = \cos(2k\Delta\phi)$ $s(k) = \sin(2k\Delta\phi)$ $\Delta\phi = 2\pi\ m/(2n+1)$ where $m$ and $(2n+1)$ have no common divisors.

$f(k,\phi) = \cos(2k\ \Delta\phi) - (c/R)\cos\phi$ $a = (1/2)(1 - (c/R)^2)$ $$s_0(\phi) = (a \cdot r^2(\phi))/R^2 \sum_{k=1}^{n} s(k)/[f^2(k,\phi) - 2a \cdot c(k) f(k,\phi) + a^2]$$

$$\delta = \rho - b$$

$\rho$ = radius of vane guide roller $b$ = radius of milling cutter or grinding wheel.

Of course, $b = 0$, (26) gives us the equation for the profile of the vane (path GH in FIG. 6). If $b = \rho$ then $\delta = 0$ and we obtain the path of the center of the vane guide relative to the vane (path DE of FIG. 6).

In FIG. 7 there is shown a second embodiment of the device of the invention; in such embodiment the vane guides comprise two mutually contracting rollers constituting a roll set disposed between successive vanes. Parts in FIG. 7 which are similar to those in FIGS. 2–6, inclusive, are designated by the same reference characters with an added prime. The embodiment of FIG. 7 is of advantage in that the rollers rotate in directions, as they travel radially in and out, such that they do not scuff the lateral surfaces 24' of the vanes. Thus, for example, when the bottom pair of rollers is travelling radially outwardly as shown the left-hand roller 25' rotates clockwise and the right-hand roller rotates counterclockwise.

In FIG. 8 there is shown a third embodiment of the device of the invention. Parts in FIG. 8 which are similar to those in FIG. 2 are designated by the same reference characters with an added double prime.

The vane guides in FIG. 8 comprise two spaced parallel cylindrical rollers 21' which are journalled for free rotation on a supporting body 46. Rollers 21 sealingly engage the surfaces 24'' of the respective vanes 19''. Means not specifically shown are provided on body 46 to effect a seal between it and the rollers 21''.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims. The terms "milling cutter" and "cutter" used herein are intended also to include grinding and the like.

What is claimed is:

1. The method of making vanes for an eccentric rotor vane device having a main chamber having a substantial cylindrical interior surface, first and second ports spaced around and communicating with said main chamber, a plurality of angularly related radial vanes, independently pivotal and rotatable within said main chamber about a vane axis therewithin, said vanes occupying substantially the total radial distance from said axis to said interior surface of said main chamber, a rotor that is eccentrically mounted with respect to said main chamber and rotatable about a rotor axis spaced from said vane axis said rotor having vane guides for interdigitating said vanes and effecting a change in volume of a sub chamber intermediate respective pairs of said vanes as said rotor and said vanes are rotated within said main chamber, each sub chamber being defined by a pair of confronting lateral vane surfaces and a corresponding vane guide between said lateral vane surfaces and said main chamber interior surface and varying from a minimum volume at the radially outermost position of said vane guides with respect to said vane axis, and a power delivery shaft connected with said rotor for delivering power in association therewith, comprising forming each of said confronting vane surfaces by cutting it with a rotating cutter the axis of which travels with respect to the longitudinal ($x$) axis of the vane and the transverse axis ($y$) of the vane along a path which is substantially defined by the following:

$$x(\phi) = x_{DE}(\phi) + \delta[y_{DE}(\phi) + x_{DE}(\phi) \cdot s_O(\phi)]/[r(\phi) \cdot \sqrt{1 + (s_O(\phi))^2}]$$

$$y(\phi) = y_{DE}(\phi) - \delta[x_{DE}(\phi) - y_{DE}(\phi) \cdot s_O(\phi)]/[r(\phi) \cdot \sqrt{1 + (s_O(\phi))^2}]$$

where $$O \leq \phi \leq \pi$$

$x_{DE}(\phi) = r(\phi)\ \mathrm{Re}\exp(i\alpha(\phi))$ $y_{DE}(\phi) = r(\phi)\ \mathrm{Im}\exp(i\alpha(\phi))$ $r(\phi) = \sqrt{R^2 + c^2 - 2cR\cos\phi}$ $$\exp(i\alpha(\phi)) = (-1)^m \prod_{k=1}^{n} \frac{[(c(k) \cdot f(k,\phi) - a) - is(k) \cdot f(k,\phi)]}{[f^2(k,\phi) - 2a \cdot c(k)\ f(k,\phi) + a^2]^{1/2}}$$

$c(k) = \cos(2k\ \Delta\phi)$ $s(k) = \sin(2k\ \Delta\phi)$ $\Delta\phi = 2\pi m/(2n+1)$ where $m$ and $n$ are positive integers such that $m$ and $2n+1$ have no common divisors $f(k,\phi) = \cos(2k\ \Delta\phi) - (c/R)\cos\phi$ $a = (1/2) \cdot [1 - (c/R)^2]$ $$s_0(\phi) = (a \cdot r^2(\phi)/R^2) \cdot \sum_{k=1}^{n} s(k)/[f^2(k,\phi) - 2a\ c(k) \cdot f(k,\phi) + a^2]$$

R = radius of vane guide circle (distance from center of rotor axis to center of right circular cylindrical vane guide surface which engages vane).

$c$ = distance between vane axis at center of main chamber and rotor axis at center of vane guide circle.

$\delta = \rho - b$ $\rho$ = radius of right circular cylindrical vane guide surface which engages vane.

b = radius of milling cutter.

2. In an eccentric rotor vane device having a main chamber having a substantial cylindrical interior surface, first and second ports spaced around and communicating with said main chamber, a plurality of angularly related radial vanes independently pivotal and rotatable within said main chamber about a vane axis therewithin, said vanes occupying substantially the total radial distance from said axis to said interior surface of said main chamber, a rotor that is eccentrically mounted with respect to said main chamber and rotatable about a rotor axis spaced from said vane axis. said rotor having vane guides for interdigitating and accurately engaging and guiding said vanes as said rotor and said vanes are rotated within said main chamber, and a power delivery shaft connected with said rotor for delivering power in association therewith, the improvement wherein each of said confronting vane surfaces has a contour with respect to the longitudinal ($x$) axis of the vane and the transverse axis ($y$) of the vane which is substantially defined by the following:

$$x(\phi) = x_{DE}(\phi) + \rho[y_{DE}(\phi) + x_{DE}(\phi)\cdot s_O(\phi)]/[r(\phi)\sqrt{1+(s_O(\phi))^2}]$$

$$y(\phi) = y_{DE}(\phi) - \rho[x_{DE}(\phi) - y_{DE}(\phi)\cdot s_O(\phi)]/[r(\phi)\sqrt{1+(s_O(\phi))^2}]$$

where $$O \leq \phi \leq \pi$$

$$x_{DE}(\phi) = r(\phi)\ \mathrm{Re}\exp(i\alpha(\phi))$$

$$y_{DE}(\phi) = r(\phi)\ \mathrm{Im}\exp(i\alpha(\phi))$$

$$r(\phi) = \sqrt{R^2+c^2-2cR\cos\phi}$$

$$\exp(i\alpha(\phi)) = (-1)^m \prod_{k=1}^{n} \frac{[(c(k)\cdot f(k,\phi)-a)-i\,s(k)\,f(k,\phi)]}{[f^2(k,\phi)-2a\cdot c(k)\,f(k,\phi)+a^2]^{1/2}}$$

$$c(k) = \cos(2k\,\Delta\phi)$$

$$s(k) = \sin(2k\,\Delta\phi)$$

$\Delta\phi = 2\pi m/(2n+1)$ where $m$ and $n$ are positive integers such that $m$ and $2n+1$ have no common divisors $$f(k,\phi) = \cos(2k\,\Delta\phi) - (c/R)\cos\phi$$

$$a = (1/2)[1-(c/R)^2]$$

$$s_0(\phi) = [a\cdot r^2(\phi)/R^2]\cdot \sum_{k=1}^{n} s(k)/[f^2(k,\phi)-2a\cdot c(k)\cdot f(k,\phi)+a^2]$$

R = radius of vane guide circle (distance from center of rotor axis to center of right circular cylindrical vane guide surface which engages vane).

$c$ = distance between vane axis at center of main chamber and rotor axis at center of vane guide circle.

$\rho$ = radius of right circular cylindrical vane guide surface which engages vane.

3. A device according to claim 2, wherein the portions of the surfaces of the vane guides which engage the vanes are right circular cylindrically curved in transverse section in a direction radial of the vanes.

4. A device according to claim 2, wherein the vane guides comprise two mutually engaging circular cylindrical rollers which span the distance between and engage each other and the respective lateral vane surfaces.

5. A device according to claim 2, wherein the vane guides comprise two spaced parallel circular cylindrical rollers journalled on a supporting body.

6. A device according to claim 2, wherein the vane guides comprise circular cylindrical rollers, the peripheral surfaces of which engage the respective lateral vane surfaces.

7. A device according to claim 6, wherein one roller is disposed between each consecutive pair of vanes.

8. A device according to claim 6, wherein the number of vanes is odd.

9. In an eccentric rotor vane device having a main chamber having a substantial cylindrical interior surface, first and second ports spaced around and communicating with said main chamber, a plurality of angularly related radial vanes independently pivotal and rotatable within said main chamber about a vane axis therewithin, said vanes occupying substantially the total radial distance from said axis to said interior surface of said main chamber, a rotor that is eccentrically mounted with respect to said main chamber and rotatable about a rotor axis spaced from said vane axis, said rotor having vane guides for interdigitating said vanes and effecting a change in volume of a sub chamber intermediate respective pairs of said vanes as said rotor and said vanes are rotated within said main chamber, each sub chamber being defined by a pair of confronting lateral vane surfaces and a corresponding vane guide between said lateral vane surfaces and said main chamber interior surface and varying from a minimum volume at the radially outermost position of said vane guides with respect to said vane axis, and a power delivery shaft connected with said rotor for delivering power in association therewith, the improvement wherein each of said confronting vane surfaces has a contour with respect to the longitudinal ($x$) axis of the vane and the transverse axis ($y$) of the vane which is substantially defined by the following:

$$x(\phi) = x_{DE}(\phi) + \rho[y_{DE}(\phi) + x_{DE}(\phi)\cdot s_O(\phi)]/[r(\phi)\sqrt{1+(s_O(\phi))^2}]$$

$$y(\phi) = y_{DE}(\phi) - \rho[X_{DE}(\phi) - y_{DE}(\phi)\cdot s_O(\phi)]/[r(\phi)\sqrt{1+(s_O(\phi))^2}]$$

where $$O \leq \phi \leq \pi$$

$$x_{DE}(\phi) = r(\phi)\ \mathrm{Re}\exp(i\alpha(\phi))$$

$$y_{DE}(\phi) = r(\phi)\ \mathrm{Im}\exp(i\alpha(\phi))$$

$$r(\phi) = \sqrt{R^2+c^2-2cR\cos\phi}$$

$$\exp(i\alpha(\phi)) = (-1)^m \prod_{k=1}^{n} \frac{[(c(k)\cdot f(k,\phi)-a)-i\,s(k)\,f(k,\phi)]}{[f^2(k,\phi)-2a\cdot c(k)\,f(k,\phi)+a^2]^{1/2}}$$

$$c(k) = \cos(2k\,\Delta\phi)$$

$$s(k) = \sin(2k\,\Delta\phi)$$

$\Delta\phi = 2\pi m/(2n+1)$ where $m$ and $n$ are positive integers such that $m$ and $2n+1$ have no common divisors $$f(k,\phi) = \cos(2k\,\Delta\phi) - (c/R)\cos\phi$$

$$a = (1/2)[1-(c/R)^2]$$

$$s_0(\phi) = [a\cdot r^2(\phi)/R^2]\cdot \sum_{k=1}^{n} s(k)/[f^2(k,\phi)-2a\cdot c(k)\cdot f(k,\phi)+a^2]$$

R = radius of vane guide circle (distance from center of rotor axis to center of right circular cylindrical vane guide surface which engages vane).

$c$ = distance between vane axis at center of main chamber and rotor axis at center of vane guide circle.

$\rho$ = radius of right circular cylindrical vane guide surface which engages vane.

10. A device according to claim 9, wherein the portions of the surfaces of the vane guides which engage the vanes are right circular cylindrically curved in transverse section in a direction radial of the vanes.

11. A device according to claim 9, wherein the vane guides comprise two mutually engaging circular cylindrical rollers which span the distance between and sealingly engage each other and the respective lateral vane surfaces.

12. A device according to claim 9, wherein the vane guides comprise two spaced parallel circular cylindrical rollers journalled on a supporting body and having their peripheral surfaces sealed thereto.

13. A device according to claim 9, wherein the vane guides comprise circular cylindrical rollers, the peripheral surfaces of which engage and effect a seal with the respective lateral vane surfaces.

14. A device according to claim 13, wherein one roller is disposed between each consecutive pair of vanes.

15. A device according to claim 13, wherein the number of vanes is odd.

* * * * *

UNITED STATES PATENT OFFICE

CERTIFICATE OF CORRECTION

Patent No. 3,938,918 Dated February 17, 1976

Inventor(s) John SNYGG and Vello H. EBROK

It is certified that error appears in the above-identified patent and that said Letters Patent are hereby corrected as shown below:

Line 48 of col. 5 should read $\alpha(\phi+(2n-2)\Delta\phi)+\alpha(\phi(2n-1)\Delta\phi)=$ Line 36 of col. 6 should read $-\alpha(\phi + (2n-1)\Delta\phi) - \alpha(\phi + 2n\Delta\phi) = \theta(\phi + (2n-1)\Delta\phi) -$ The first string of equations in lines 50-52 of col. 6 should read $\alpha(\phi) + \alpha(\phi + (2n+1)\Delta\phi) = \alpha(\phi) + \alpha(\phi + 2\pi m) = 2\alpha(\phi)$ The second string of equations in lines 50-52 of col. 6 should read $\theta(\phi + (2n+1)\Delta\phi) - \theta(\phi) = \theta(\phi + 2\pi m) - \theta(\phi) = 2\pi m$ The first equation in lines 30, 31, and 32 of col. 7 should read $\exp i\,\theta(\phi - 2k\Delta\phi) = R[\exp(i\phi - i2k\Delta\phi) - c/R]/r(\phi - 2k\Delta\phi)$ The second equation in lines 30, 31 and 32 of col. 7 should read $\exp i\,\theta(-\phi - 2k\Delta\phi) = R[\exp(-i\phi - i2k\Delta\phi) - c/R]/r(-\phi - 2k\Delta\phi)$ Lines 41, 42, and 43 of col. 7 should read $\exp(i\phi) + \exp(-i\phi) = 2\cos\phi$ $\exp(-i4k\Delta\phi) = \exp(-i2k\Delta\phi)\cdot(\exp(-i2k\Delta\phi) + \exp(i2k\Delta\phi)) - 1$ $= 2\cos(2k\Delta\phi)\exp(-i2k\Delta\phi) - 1$

UNITED STATES PATENT OFFICE

CERTIFICATE OF CORRECTION

Patent No. 3,938,918 Dated February 17, 1976

Inventor(s) John SNYGG and Vello H. EBROK

It is certified that error appears in the above-identified patent and that said Letters Patent are hereby corrected as shown below:

Line 6 of column 8 should read $$\exp(i\alpha(\phi)) = (-1)^m \prod_{k=1}^{n} \frac{[(c(k)\cdot f(k,\phi)-a) - i2(k)\cdot f(k,\phi)]}{[f^2(k,\phi) - 2ac(k)\cdot f(k,\phi) = a^2]^{1/2}} \quad (2$$

Line 62 of column 8 should read $$r(\phi) = \sqrt{R^2 + c^2 - 2cR\cos\phi}$$

Line 58 of colunb 10 should read
$\delta = \rho - b$. And $\rho$ = radius of right circular cylindrical vane guide surface which engages vane.

Signed and Sealed this

*Twenty-fifth* Day of *September 197*

[SEAL]

*Attest:*

*Attesting Officer*

LUTRELLE F. PARKER

*Acting Commissioner of Patents and Trademarks*